United States Patent [19]

McKane, Jr.

[11] 4,366,840

[45] Jan. 4, 1983

[54] FLUID INJECTOR SPRAY DEVICE

[76] Inventor: Thomas D. McKane, Jr., 4537 Tradewinds Ave., Lauderdale-by-the-Sea, Fla. 33308

[21] Appl. No.: 305,153

[22] Filed: Sep. 24, 1981

Related U.S. Application Data

[63] Continuation-in-part of Ser. No. 146,635, May 5, 1980, abandoned.

[51] Int. Cl.[3] ..... F16K 19/00

[52] U.S. Cl. ..... 137/894; 137/599.1; 239/318

[58] Field of Search ..... 137/894, 599.1; 239/317, 318

[56] References Cited

U.S. PATENT DOCUMENTS

| | | | |
|---|---|---|---|
| 1,640,945 | 8/1927 | Leibing | 137/894 |
| 2,507,410 | 5/1950 | Kemp | 137/599.1 |
| 2,719,704 | 10/1955 | Anderson | 239/318 X |
| 3,231,200 | 1/1966 | Heald | 239/318 |
| 3,612,404 | 10/1971 | Vicari | 239/317 X |
| 3,801,017 | 4/1974 | Jarzynski | 239/318 X |

*Primary Examiner*—Robert G. Nilson
*Attorney, Agent, or Firm*—Joseph Zallen

[57] ABSTRACT

A flow selectable fluid mixing device having a main manifold member (10) with a main fluid path (13) and a venturi creating conical secondary fluid path (14) and a rotatable manifold member (12) mounted on the main manifold member (10). The rotatable member (12) has valve gate means (19) which rotates within the main fluid path (13) of the main manifold member thereby controlling the fluid through that path. The rotatable member (12) also has an auxiliary fluid supply orifice (27) alignable with a venturi orifice (28) which is in fluid communication with the secondary conical fluid path (14) of the main member (10). The auxiliary fluid supply orifice (27) is in a fixed position with the valve gate means (19) such that three qualities of flow are selectable as the rotatable member (12) is rotated.

3 Claims, 7 Drawing Figures

FLUID INJECTOR SPRAY DEVICE

BACKGROUND OF INVENTION

This is a continuation-in-part of co-pending application, Ser. No. 146,635 filed May 5, 1980, now abandoned.

This invention relates to a mechanical fluid mixing spray device for dispensing a mixture of concentrate with a principal fluid.

The present invention presents a new and improved device which provides selectable flows with the minimum number of parts. No spring or diaphrams are required. Operation is done by rotating a first manifold component on a second manifold component to obtain three flow variations.

SUMMARY OF INVENTION

The present invention comprises a spray device which mixes a fluid concentrate with a main fluid, such as mixing soap with water. The non-complex structure utilizes the venturi principle by placing a nozzle or orifice fed by the fluid concentrate into the turbulent flow path of the main fluid.

Figure 5:
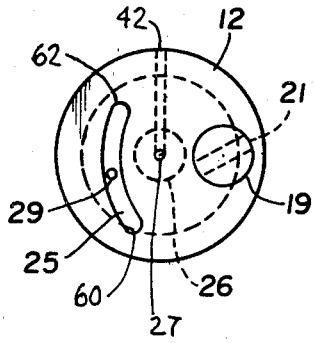
FIG. 5 is a bottom view of the second manifold member.

The device consists of two manifold members, a main manifold and a second manifold, which are machine fitted together with the second manifold rotating on the other. The main manifold has a main fluid path and an estuarial path. A venturi is connected to the estuarial path. The venturi section where the concentrate from the second manifold mixes with the fluid in the estuarial path. The main path is gated by the first manifold member which fits onto and into the main manifold member. The relationship of the fluid paths and orifices between the two manifolds permits the selection of three flow qualities as the second manifold member is rotated on the main manifold member, namely heavy main fluid, light main fluid and light main fluid mixed with auxiliary fluid. In the first position as shown in FIG. 5 only the estuarial path is open with no flowing concentrate. In this position the main path is opened allowing heavy flow of the main fluid and flow of the estuarial path with no dispensed concentrate. The concentrate supply is not in hydraulic communication with the venturi orifice in order to allow the concentrate to flow. The open position is obtained by moving the second manifold in a counterclockwise manner on the main manifold. The second manifold is again moved in a counterclockwise manner, the main path is again closed, the estuarial path is still open and the concentrate supply is placed in fluid communication with the venturi orifice causing a light flow of mixed fluid and concentrate.

That is the opening in the second manifold is placed in position over venturi opening in the main manifold.

Thus three quality flows are selectable by the rotating of the second manifold on the main manifold. The main manifold is equipped with a connection means at its input and output ports that will allow attachment to a hose, shower head or other device. The second manifold has a means for connecting to a concentrate supply by directly receiving a container means such as a plastic bottle.

The present invention represents a selectable device with a minimum of moving parts and non-complex construction which has not heretofore been equalled.

SPECIFIC EXAMPLE OF INVENTION

Figure 1:
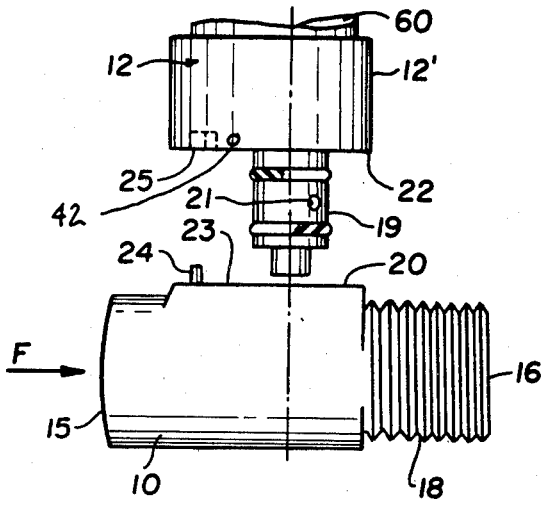
FIG. 1 is a side view of an explosion of the assembly.
Figure 2:
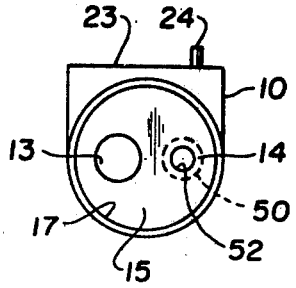
FIG. 2 is a left end view of the main body or manifold member showing the inlet port.
Figure 3:
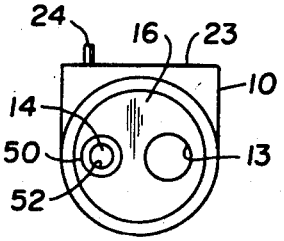
FIG. 3 is the other end view of the main manifold member showing the outlet port.
Figure 4:
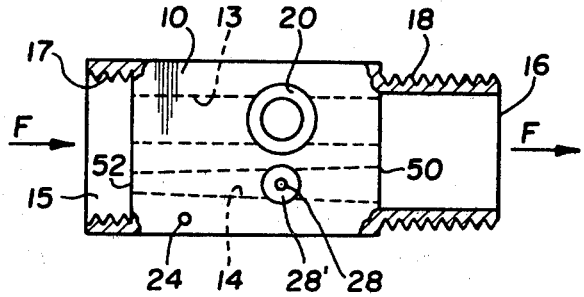
FIG. 4 is a partial cutaway top view cross-section of the main manifold member.
Figure 6:
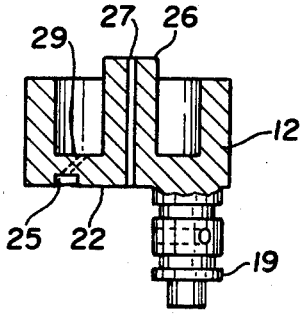
FIG. 6 is a side cross-section view of the second manifold member.

Referring now to the drawings the present invention consists of an assembly shown in FIG. 1 and a first manifold member 10 as shown in FIGS. 2, 3, 4 and a second manifold member 12 shown in FIGS. 5 and 6. Referring more specifically to FIGS. 1 and 4, the main body or main manifold member 10 is constructed from a single member of rigid material having a main fluid path 13 of one diameter therethrough and a smaller conical shaped fluid path 14 or another embodiment not shown having a first conduit of a diameter of the inlet 52 and a second conduit of a diameter of the outlet 50. In this second embodiment of the conical shaped fluid path 14, not shown, the first and second conduits would meet at the opening 28 surrounded by o-ring 28'. The fluid paths 13 and 14 provide a fluid communication means between the inlet portion 15 and the outlet portion 16 with the larger cross-section area of the smaller conical path 14 towards the outlet portion 16. The inlet 15 and outlet portions 16 are provided with a mechanical connection means 18 and 17 respectively such as a threaded section which will allow the invention to be connected into almost any desired fluid path. The assembly may be connected between a shower head and the distal end of the supply conduit.

The manifold member 12 shown in FIGS. 1 and 4 fits onto the main manifold member 10 with the valve gate means 19 being received into the cylindrical receiving means 20. When the valve gating means 19, that is off-center in relationship to the cap 12, is fully inserted the mating surface 22 bears against the o-ring 28' on the main body or main manifold member 10.

The first manifold member 12 has an adjuvant or auxiliary supply connection means or post 26 with an adjuvant supply orifice 27 which is in fluid communication with the mating surface 22. During one point of the rotational travel of the cap 12 on the main manifold 10 the adjuvant supply orifice 27 aligns with the venturi orifice 28 creating an adjuvant fluid communication path to the conical fluid path 14 in the main manifold member 10. The concentrated fluid in a container 60 is drawn into fluid path 14. A tube not shown is positioned over member 26 to draw fluid from container 60 when the container 60 is lower than the body 10. The tube may also connect to a remote container positioned above or below body 10. The flow in the direction of arrow F of fluid through the conical path 14 creates a venturi effect drawing the adjuvant fluid through orifice 28 and into the main fluid stream. Evacuation orifice 29 or path 29 shown in FIG. 5, serves to eliminate vacuum build up in the adjuvant supply container as its contents are drawn into the main fluid.

Three flow qualities are selectable by rotating the first manifold member 12 on the main manifold member 10. In the first end of rotational travel with pin 24 at end 62 of groove 25, orifice 21 disposed in the valve gate means 19 may be aligned with the main fluid path 13 providing one flow with the conduit 13 and 14 open. The adjuvant supply orifice 27 is aligned in fluid communication with venturi orifice 28 of the main manifold member 10 in only one position with pin 24 at end 60 providing a second flow of fluid from 27. In the intermediate rotational positions orifice 21 is non-aligned with the main fluid path 13 and acts as a valve gate means 19 to block the main fluid flow through that path providing a third flow. A light flow of fluid is provided when only the conical path 14 is open. When the adjuvant supply orifice 27 is in fluid communication with the venturi orifice 28 a light flow of a mixture of the fluid and concentrate material is produced.

This device is advantageous because of its non-complex design and minimum number of parts. In the preferred embodiment the invention may be constructed of a non-corrosive metal or a rigid plastic.

Figure 7:
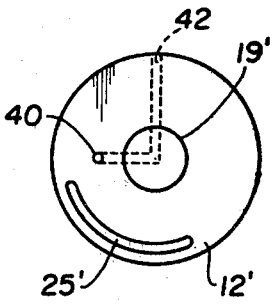
FIG. 7 is a bottom view of another embodiment of the manifold member.

FIG. 7 illustrates another manifold with the valve gate means 19' centrally located on member 12'. The opening for the flow of concentrate exits out 40. An air relief conduit is shown at 42.

The instant invention has been shown and described herein in what is considered to be the most practical and preferred embodiments. It is recognized, however, that departures may be made therefrom within the scope of the invention and that obvious modifications will occur to a person skilled in the art.

Industrial Applicability

A fluid injector spray device for use between a fluid conduit and a spray head.

I claim:

1. A fluid mixing device for use with a main fluid flow and an auxiliary fluid, comprising the combination of a main member and a movable member; said main member having fluid inlet means, fluid outlet means, a main fluid flow path, a separate relatively smaller conical fluid flow path, both said paths being in fluid communication with said inlet and outlet means, a cylindrical receiving means, and an auxiliary supply orifice, said receiving means intersecting said main fluid flow path and said auxiliary supply orifice being in fluid communication with said conical fluid flow path; said movable member having orifice means for connection with a container of auxiliary fluid and said auxiliary supply orifice so as to provide fluid communication for said auxiliary fluid to said conical fluid flow path and being alignable with said auxiliary supply orifice, a cylindrical valve gate means connected to said movable member and an air purge orifice; said valve gate means being disposed in said receiving means and including fluid communication means extending through it; said movable member being so characterized that its rotation in said receiving means rotates said valve gate means so as to selectively provide heavy main fluid flow, light main fluid flow and a mixture of light main fluid flow with auxiliary fluid.

2. The fluid mixing device of claim 1 wherein: said conical fluid flow path tapers from the outlet to the inlet means, said main member having a protruding guide pin, and an o-ring on the exterior of said auxiliary supply orifice; said movable member is positionable so that the exterior end of said connection orifice means is registerable and in contact with said o-ring; said valve gate means protrudes from said movable member and has its fluid communication means spaced between two o-ring seals and an arcuate alignment groove is provided in said movable member for receiving said guide pin.

3. The fluid mixing device of claim 1 or 2 wherein rotation of said movable member selectively causes said valve gate to selectively:

(a) align its fluid communication means with said main fluid flow path but not align said auxiliary supply orifice with said connection orifice means;

(b) or block said main fluid flow path with no alignment between said auxiliary supply orifice and said connection orifice means;

(c) or block said main fluid flow path but align said auxiliary supply orifice with said connection orifice means.

* * * * *